United States Patent [19]

Denley

[11] 4,414,452

[45] Nov. 8, 1983

[54] MEANS FOR ATTACHING AUXILIARY DEVICES TO A MEMBRANE SWITCH

[75] Inventor: Ronald S. Denley, Woodstock, Ill.

[73] Assignee: Oak Industries Inc., Rancho Bernardo, Calif.

[21] Appl. No.: 448,929

[22] Filed: Dec. 13, 1982

[51] Int. Cl.[3] ..... H01H 13/12; H01H 9/02

[52] U.S. Cl. ..... 200/159 B; 200/312; 200/317

[58] Field of Search ..... 200/159 B, 310, 312, 200/314, 317; 339/17 F, 176 MF

[56] References Cited

U.S. PATENT DOCUMENTS

| | | | |
|---|---|---|---|
| 3,681,723 | 8/1972 | Goll | 200/159 B X |
| 4,056,701 | 11/1977 | Weber | 200/314 |
| 4,352,963 | 10/1982 | De Filippis et al. | 200/159 B X |

*Primary Examiner*—Stephen Marcus
*Assistant Examiner*—Renee S. Kidorf
*Attorney, Agent, or Firm*—Kinzer, Plyer, Dorn & McEachran

[57] ABSTRACT

A membrane switch has a substrate, a flexible membrane and an intervening spacer. Switch contacts are formed on the top surface of the substrate and the underside of the membrane in spaced, facing relation. A hole in the spacer in register with the switch contacts allows the contacts to move together in response to pressure exerted on the membrane. An auxiliary electrical device can be incorporated into the membrane switch through an opening in the membrane which provides access to a current supply circuit which is formed on the top surface of the spacer. The auxiliary device is held in place in electrical contact with the current supply circuit on the spacer. A pair of current supply leads provide electrical power to the current supply circuit. In a preferred embodiment at least one of the current supply leads is formed on the underside of the membrane, in contact with the current supply circuit and also connected to the switch contact on the membrane.

6 Claims, 3 Drawing Figures

MEANS FOR ATTACHING AUXILIARY DEVICES TO A MEMBRANE SWITCH

SUMMARY OF THE INVENTION

This invention relates to membrane switches and is particularly concerned with the incorporation of auxiliary electrical devices into such switches.

A primary object of the invention is an electrical circuit for providing power to a discrete electrical device incorporated in a membrane switch.

Another object is a circuit of the type described which utilizes the electrical leads associated with the membrane switch circuitry.

Another object is a membrane switch which readily accommodates auxiliary discrete devices.

Another object is a membrane switch which locates a current supply circuit on the top surface of the spacer.

Other objects will appear in the following specification, drawings and claims.

DESCRIPTION OF A PREFERRED EMBODIMENT

This invention relates to membrane switches of the type used in keyboards, control panels and similar devices. A persistent problem in this field has been the incorporation of discrete electrical devices into the membrane switch without exposed circuitry. For example, in a membrane switch keyboard it is often desired to provide a light indicating the operative condition of one of the switches. This can be done with a light emitting diode but since the electrical leads are all formed on the thin flexible sheets of the membrane switch panel, it has been a troublesome matter to connect the LED to the electrical leads on the membrane switch. One of the problems in effecting such a connection is assuring physical contact between the leads of the LED and the electrical traces supplying power to the LED. Another problem has been the avoidance of interference between the power supply leads and the electrical components of the membrane switch. The present invention solves these problems by providing a current supply circuit for the LED which is formed on top of the membrane switch spacer.

Figure 1:
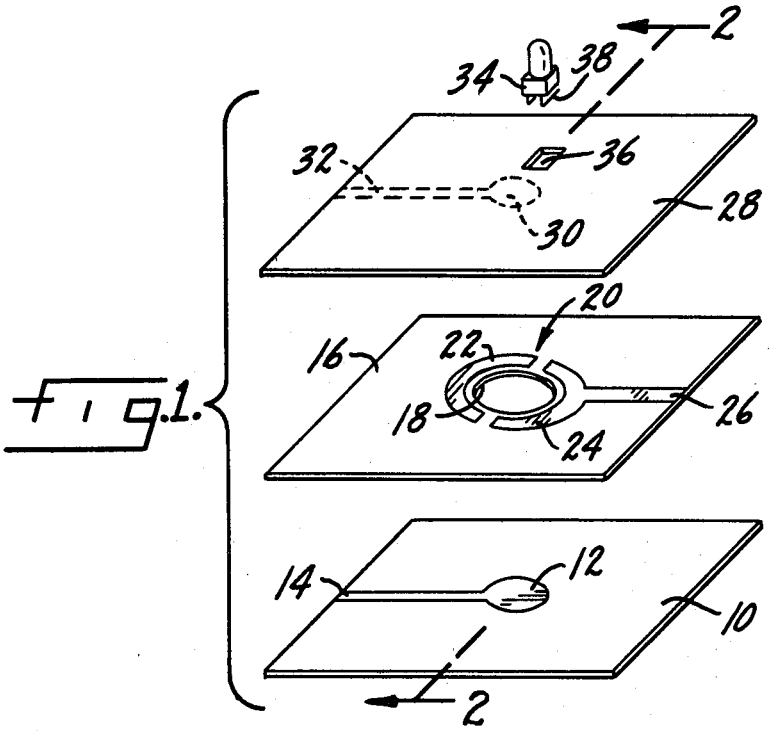
FIG. 1 is an exploded, perspective view of a switch according to the present invention.
Figure 2:
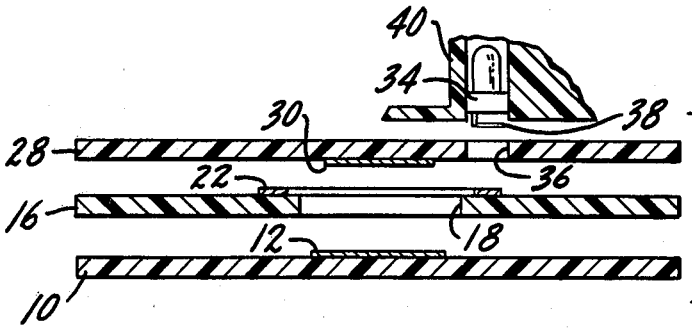
FIG. 2 is an exploded section taken generally along line 2—2 of FIG. 1.

Looking at FIGS. 1 and 2, a membrane switch according to the present invention is shown in exploded form. The membrane switch includes an insulative substrate 10 which may be either flexible or rigid as desired. The substrate has a first switch contact 12 formed on its top surface. A switch trace 14 extends on the top surface of the substrate, from the switch contact 12 to an edge of the substrate where it will be connected to the host device. The switch contact 12 and trace 14 can be deposited on the substrate in a known manner, e.g., screen printing, etching or painting with conductive ink.

A spacer 16 overlies the substrate 10. The substrate may conventionally be formed from a plastic sheet material such as polyester. The spacer has an aperture 18 extending through it which is in register with the switch contact 12 on the substrate. On the top surface of the spacer 16 is a current supply circuit shown generally at 20. In the embodiment shown the current supply circuit comprises a pair of spaced electrodes 22 and 24 which generally surround the spacer aperture 18. A current supply lead 26, formed on the top surface of the spacer 16, connects the electrode 24 to an external power supply (not shown).

A flexible membrane 28 lies on top of the spacer 16. It will be understood that the membrane, spacer and substrate are all fastened together wither mechanically, adhesively or otherwise. The membrane is made of flexible material such as polyester. It has a second switch contact 30 formed on its bottom surface. The switch contact 30 is in register with the aperture 18 in the spacer and with the first switch contact 12 on the substrate. The switch contact 30 is connected to the host device by a current supply lead 32. The parts thus far described form a conventional membrane switch with the contacts 12 and 30 normally held in spaced, facing relation. Pressure exerted by a user on the top of the membrane 28 flexes the membrane and contact 30 through the aperture 18 in the spacer and into contact with the substrate contact 12. This closes the switch. Release of the pressure allows the membrane to return to its normal position wherein the contacts are spaced from one another. It will also be understood that although only a single switch has been shown in the drawings, the present invention is applicable to membrane switch panels having an array of many membrane switches similar to that shown.

Figure 3:
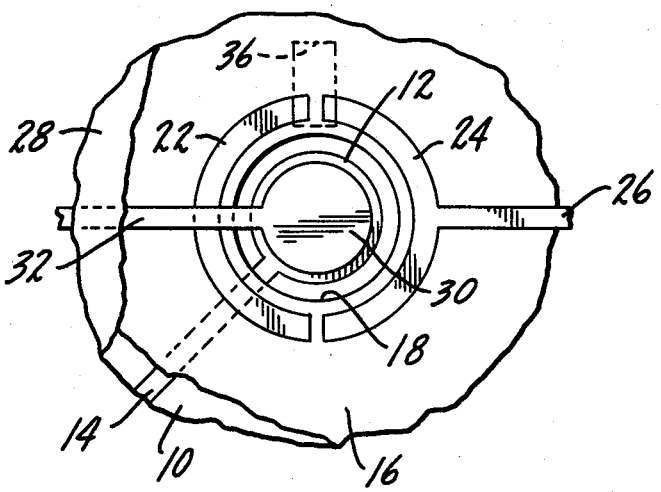
FIG. 3 is a schematic plan view, with portions cut away, of the electrical circuitry used in the switch.

In order to incorporate an auxiliary electrical device such as an LED 34, access is provided to the current supply circuit 20 by means of an opening 36 in the membrane 28. The opening 36 exposes at least a portion of the electrodes 22 and 24 (see FIG. 3). The LED 34 is placed in the opening 36 with the leads 38 of the LED in contact with the electrodes 22 and 24. The electrodes provide electrical power from an external power source to light the LED. Means for holding the LED in place are shown schematically at 40. This may be a housing of a key or any similar mechanical retention device.

The electrode 22 is provided with electrical power by virtue of contact with the power supply lead 32. The power supply lead also is connected to the switch contact 30 so it has a dual function of providing circuitry for both the LED and the membrane. Thus, there is required only one additional electrical trace (lead 26) above the number which would otherwise be necessary for the membrane switch alone.

The membrane 28 could be constructed to allow field installation of a discrete device (for example, a lighted key module). In such an alternative construction, the opening 36 would not be completely formed initially. Instead a three-sided perforation is cut in the membrane to form a tab. The tab is initially held down by adhesive to maintain a sealed switch. At some future time when it is desired to add a device to the switch, the installer would simply pry the tab back and trim it off to form the opening 36. In this manner circuitry for future use positions could be provided during manufacture of a sealed switch.

While a preferred form of the invention has been shown and described, it will be realized that many modifications could be made thereto without departing from the scope of the following claims.

I claim:

1. In a membrane switch of the type having a substrate, a first switch contact on the top surface of the substrate, a flexible membrane, a second switch contact on the bottom surface of the membrane and aligned with the first switch contact, a spacer between the substrate and membrane having an aperture in register with the switch contacts such that the contacts are normally in spaced, facing relation while pressure on the membrane top surface moves the second contact through the aperture and into engagement with the first contact thereby closing the switch, the improvement comprising means for incorporating a discrete electrical component into the membrane switch including a current supply circuit formed on the top surface of the spacer, an opening in the membrane providing access to the current supply circuit, and means for retaining the discrete component in the opening and in electrical contact with the current supply circuit.

2. The structure of claim 1 further comprising at least one current supply lead formed on the underside of the membrane and in contact with the current supply circuit to provide electrical power to said current supply circuit.

3. The structure of claim 2 wherein the current supply lead is also connected to the second switch contact.

4. The structure of claim 2 further comprising a second current supply lead formed on the top surface of the spacer and in contact with the current supply circuit to provide electrical power to said current supply circuit.

5. The structure of claim 4 wherein the current supply circuit comprises a pair of spaced electrodes, generally surrounding the spacer aperture.

6. The structure of claim 1 wherein the current supply circuit includes a pair of spaced electrodes, generally surrounding the spacer aperture.

* * * * *